United States Patent [19]

Armstong

[11] 4,161,376

[45] Jul. 17, 1979

[54] OFFSHORE FIXED PLATFORM AND METHOD OF ERECTING THE SAME

[75] Inventor: James E. Armstong, Crosby, Tex.

[73] Assignee: Pool Company, Dallas, Tex.

[21] Appl. No.: 846,317

[22] Filed: Oct. 28, 1977

Related U.S. Application Data

[63] Continuation of Ser. No. 685,791, May 20, 1976, abandoned.

[51] Int. Cl.[2] ..... E02B 17/04

[52] U.S. Cl. ..... 405/196; 405/201; 405/204

[58] Field of Search ..... 61/86, 87, 88, 89, 90, 61/91, 97; 405/196, 201, 204

[56] References Cited

U.S. PATENT DOCUMENTS

| | | | |
|---|---|---|---|
| 202,415 | 4/1878 | Cumming | 61/90 |
| 2,592,448 | 4/1952 | McMenimen | 61/97 |
| 3,044,269 | 7/1962 | Le Tourneau | 61/91 |
| 3,486,343 | 12/1969 | Gibson et al. | 61/89 |
| 3,498,477 | 3/1970 | Sommer | 114/201 R |
| 4,018,057 | 4/1977 | Erzen et al. | 61/87 X |
| 4,065,934 | 1/1978 | Dysarz | 61/91 |

OTHER PUBLICATIONS

Ocean Industry of Feb. 1976, pp. 156–158.

*Primary Examiner*—Jacob Shapiro
*Attorney, Agent, or Firm*—Richards, Harris & Medlock

[57] ABSTRACT

Disclosed is an improved fixed offshore platform and method of erecting the same. The platform has an open truss structure with upper and lower deck levels. The upper deck has removable floor sections to allow installation of equipment down through the truss structure. The platform is provided with pads for mounting equipment and housing in modules on the deck. No flotation is provided in the platform and means are provided for supporting the platform on the deck of a simple barge. The platform is generally triangular in shape having three caisson legs with one leg enlarged to allow drilling therethrough. Jacks are provided for gripping the legs and a crane is mounted on the deck to move along tracks provided thereon. In erecting the platform, the platform is first barged to the location of installation on a simple barge with the legs in a vertically-extending position and the platform in its normal operating position with the crane thereon. The barge is moored in position over a well site. At high tide, the legs are dropped and locked in position. As the tide subsides, the barge is floated from under the platform leaving the platform supported by the legs and the jacks. Next, the platform is jacked up to the desired height of use. Pilings are driven through the legs by use of the deck mounted crane. The legs are then grouted in place and welded to the platform. The jacks are removed from the legs and the equipment modules are installed. Drilling can then be accomplished through the enlarged leg.

6 Claims, 10 Drawing Figures

OFFSHORE FIXED PLATFORM AND METHOD OF ERECTING THE SAME

This is a continuation of application Ser. No. 685,791, filed May 20, 1976, now abandoned.

BACKGROUND OF THE INVENTION

The present invention relates to fixed offshore drilling and production platforms and methods of erecting the same. More particularly, the present invention relates to a non-buoyant open truss self-elevating fixed platform. In addition, the present invention relates to a fixed platform having upper and lower spaced decks which have means for mounting and receiving drilling, production and workover equipment; housing, and the like, mounted on upper and lower decks and to allow the interchange of the equipment once the platform is installed.

In the construction of fixed offshore oil platforms, it has been common to completely construct an interconnected platform leg structure in the shipyard, place the leg assembly on a derrick barge and transport the leg assembly to the position of installation by use of the derrick barge.

The leg assembly is removed from the derrick barge by the derrick crane and set in position and thereafter, pilings are driven by the derrick crane down through the legs to anchor the platform in position. Thereafter, the legs are grouted and a platform deck structure is fixed on top of the leg assembly. Thereafter, drilling, production or workover equipment can be installed on the deck and used. It has also been conventional to provide drilling through one or more of the legs of the fixed platform.

Although this type of construction has proved satisfactory, it has become apparent that the time involved in transporting the platform to the site and completing installation of the same can be substantial when it is realized that transportation and erection of the platform during most of the process requires the presence of an expensive derrick barge. In some areas, the rental alone on a large derrick barge is $10,000.00 a day, and it can be seen that this can be a substantial cost factor.

Therefore, according to one aspect of the present invention, a self-erecting offshore platform is provided which does not require the presence of a derrick barge for its transportation from the shipyard or during its erection at the site. According to another aspect of the present invention, a jack up platform is provided having an open truss platform structure with upper and lower decks and removable upper panels to allow the installation of equipment on the lower deck through openings in the upper deck.

According to more detailed aspects of the present invention, a three-legged triangular-shaped open truss platform is provided using caisson legs. One of the legs is enlarged to allow drilling therethrough and a track is provided on an upper deck for receiving a crane and allowing the crane base to move along the track. A lower deck is provided on the platform with pads and mountings for receiving equipment lowered vertically by the crane onto the lower deck. Removable panels are provided for the upper deck to allow access to the lower deck and to provide a work surface for use of the platform once it is in an operational condition. Three caisson legs are connected to the truss platform by means of jacks and are used to elevate the platform to its operational height for permanent connection of the legs to the platform.

To erect the improved platform of the present invention, the platform with the legs attached is barged to the installation site. A simple barge can be used having a cribbing for supporting the platform in its normal operating position with the legs extending vertically above and below the platform. This simple barge is moored in position and at high tide, the legs are dropped to the bottom and locked in position by the jacks. Thereafter, as the tide subsides, the simple barge is floated from under the platform and the platform is elevated by means of the jacks to its desired height. Pilings are driven through the legs by use of the deck crane. The pilings are grouted and sealed in the legs. The legs are welded to the platform and the jacks removed. Thereafter, the rig equipment modules are installed on the upper and lower decks. Thereafter, drilling can be performed through the large leg of the platform.

BRIEF DESCRIPTION OF THE DRAWINGS

The features and other aspects of the present invention can be appreciated by those of ordinary skill in the art by reference to the following detailed description when considered in connection with the accompanying Drawings in which.

DESCRIPTION

Figure 1:
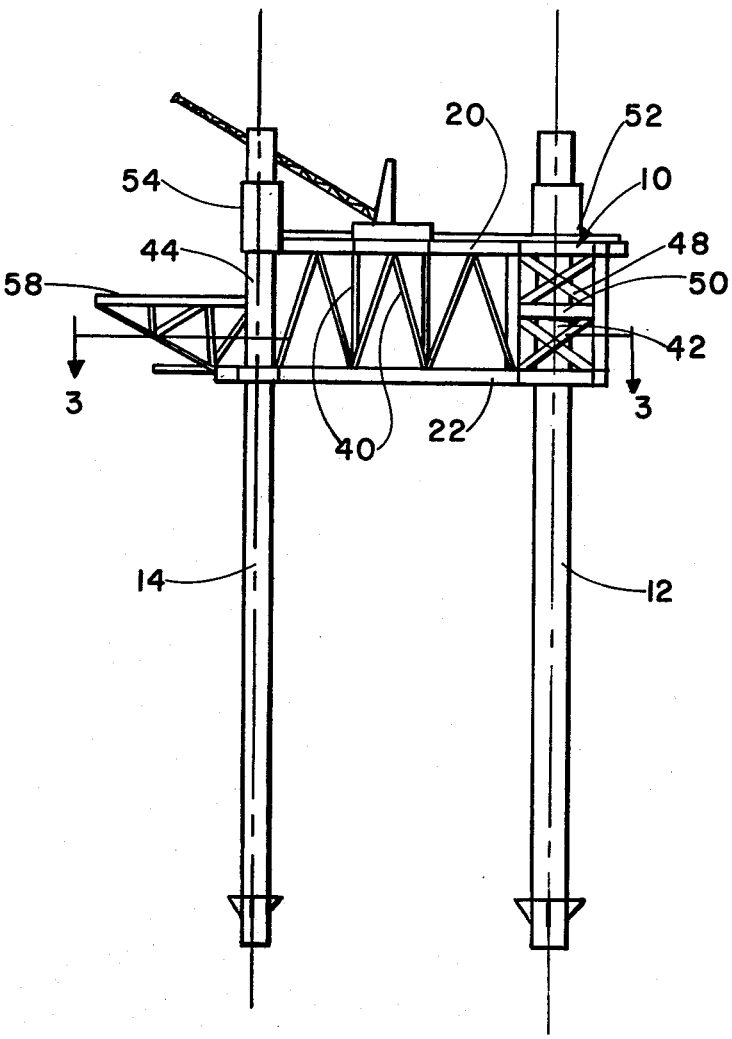
FIG. 1 is a side elevation of the platform with the legs attached and a crane in place on the deck.

Referring now to the Drawings wherein like characters designate like or corresponding parts throughout the several Figures, there is illustrated an apparatus for erecting a fixed offshore platform. The platform has a particularly advantageous open trusswork structure and is provided with caisson legs with means for raising the platform on the legs to an elevated operating position. In addition, self-contained means are provided on the platform for driving pilings down through the caisson legs and for removing the jacks and fixing the legs to the platform to form a rigid offshore platform without requiring a derrick barge.

Figure 2:
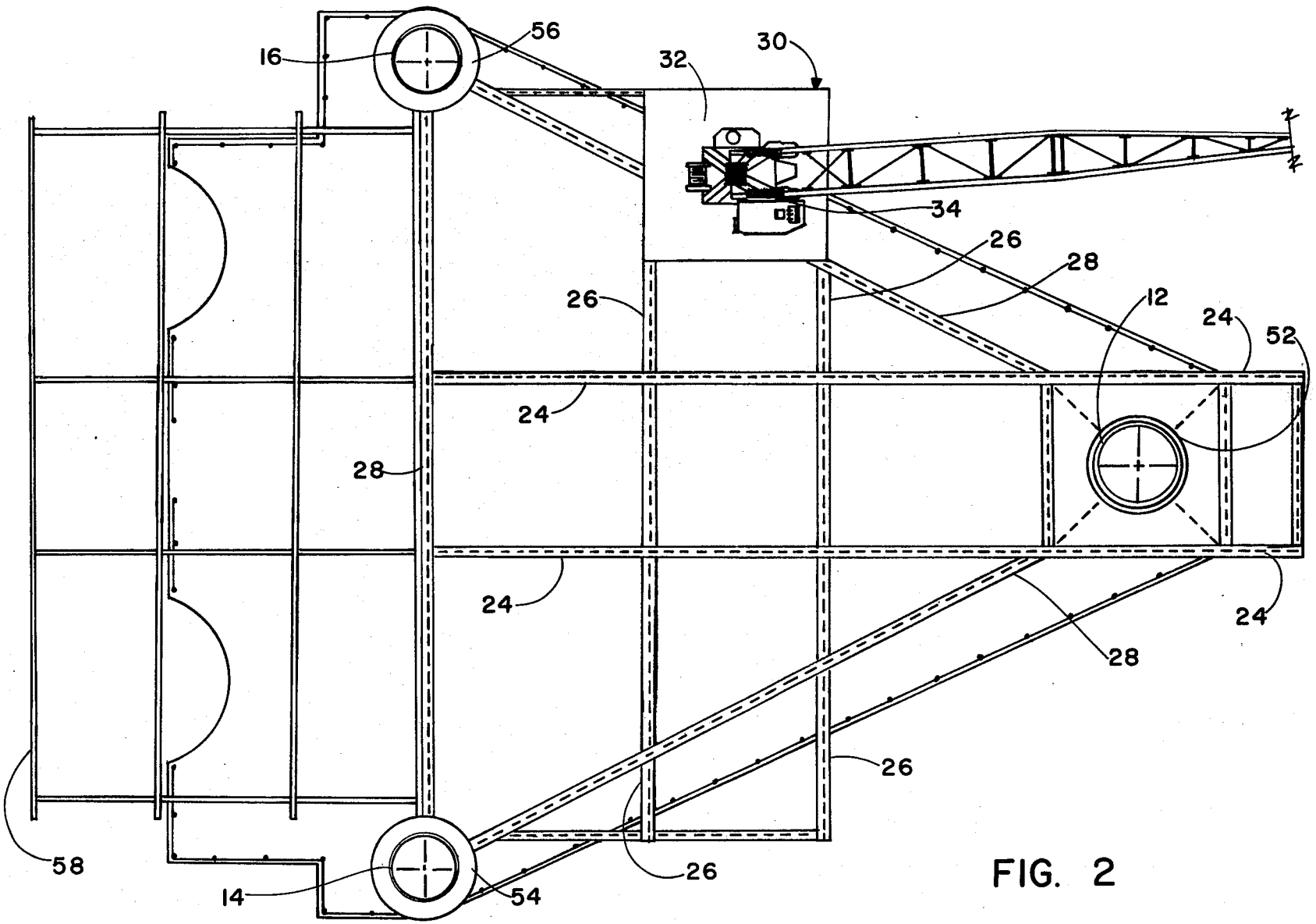
FIG. 2 is a plan view of the upper drilling deck of the embodiment platform of FIG. 1.
Figure 3:
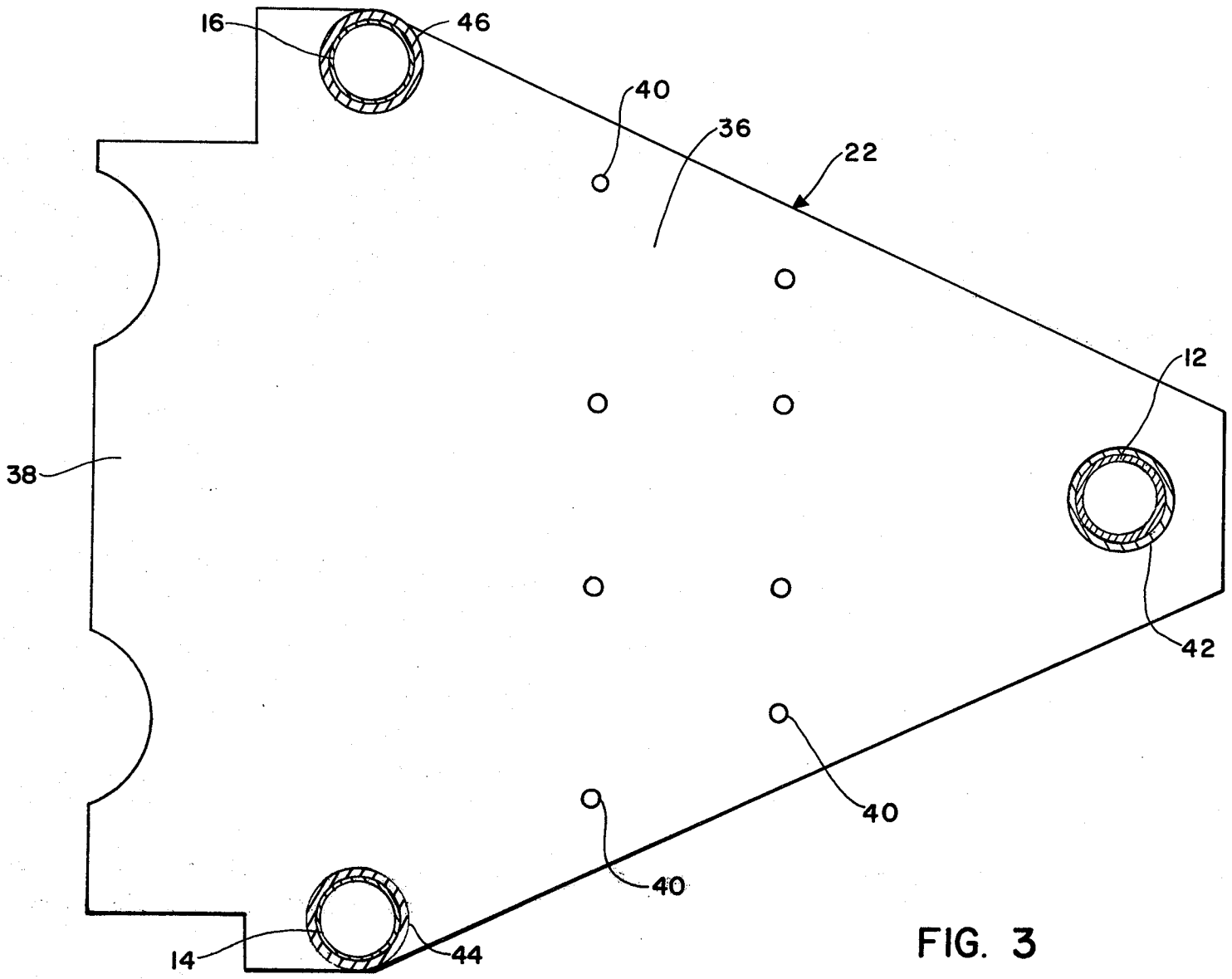
FIG. 3 is a section taken on lines 3—3 of FIG. 1, looking in the direction of arrows illustrating the lower equipment deck.

Referring particularly to FIGS. 1–3, a platform assembly 10 is illustrated having three caisson-type legs connected thereto. The platform assembly 10 has a general triangular shape with the legs being positioned at the corners of the triangle. Adjacent the front of the platform is a large leg 12 and positioned adjacent the rear corners are two smaller legs 14 and 16. In operation, these legs are lowered to and embedded in the bottom to support the platform 10 above the water surface.

The platform 10 has an upper or drilling deck area 20 (illustrated in FIG. 2) and a lower or equipment deck area 22 (illustrated in FIG. 3). During operation and use of the platform, the upper deck 20 is utilized for pipe racks, piping, drilling equipment and a work area. During operation, the lower deck 22 functions as an area in which the various pumps, generators, and the like, are located thereon. As will be subsequently described in detail, the upper deck is constructed in such a manner as to allow the insertion and removal of equipment from the lower deck for conversion of the drilling platform to a production platform or to allow the removal or exchange of any equipment mounted thereon.

Referring in detail to FIG. 2, it can be seen that the upper deck comprises a frame having a first pair of parallel spaced frame members 24 extending from the front to the back of the upper deck. A second pair of parallel spaced frame members 26 extends transverse to the frame members 24 and is centrally located on the upper deck 20. Frame members 28 extend between the legs and provide structural integrity for the upper frame. The spaces between the respective frame members in the upper deck 20 are left open and are provided with means for supporting removable panels (not shown in FIGS. 1–3) for allowing vertical access from the upper deck to the lower deck. A crane assembly 30 is supported from the upper deck 20 (see FIG. 2). This crane assembly 30 has a base 32 with a crane 34 mounted thereon. The base 32 is provided from means which engage the parallel frame members 24 and 26 and allow the base 32 to be moved along and positioned on the frame members 24 and 26, with the frame members acting as a track for the crane base. This allows the crane assembly 30 to be moved as desired to convenient positions during erection and use of the platform.

The lower deck 22 is illustrated in FIG. 3. This lower deck 22 is provided with framing not shown and a deck plating 36. The plating 36 is provided with pads and mounting foundations for receiving equipment, as will be hereinafter described in detail. It is also to be noted that the lower deck 22 has a portion 38, which extends to the rear between the legs 14 and 16.

As is illustrated in FIG. 1, the upper and lower deck assemblies 20 and 22 are interconnected by a space frame or trussing 40 which rigidly fixes the upper and lower decks 20 and 22, respectively, in a spaced parallel relationship.

Each of the legs 12, 14 and 16, is provided with a leg well 42, 44 and 46, respectively. These wells are tubular leg guides which extend between the upper and lower decks 20 and 22 (see FIG. 1). These wells 42, 44 and 46 are of a size to receive the respective legs therein in axial sliding relationship to allow the legs to be translated vertically with respect to the platform assembly 10.

In FIG. 1, it can be seen that the leg well 42 is enclosed within a rigid frame 48. This frame 48 is provided with an intermediate horizontally-extending frame member 50, engaging the well 42. As will be hereinafter described, this member 50 is utilized to weld off the leg 12 to the platform assembly 10.

These wells 42, 44 and 46 are rigidly fixed between the upper and lower decks 20 and 22, respectively. Positioned above the upper deck 20 and engaging each of the legs 12, 14 and 16, are jacks 52, 54 and 56, respectively. These jacks are connected to the upper deck 20 and are of a size to receive the respective legs and are selected to raise and lower the platform assembly 10 along the legs once the legs are in place. In the present embodiment, jacks 54 and 56 are of the De Long type D-6-6 airjacks, manufactured by De Long Corporation, 29 Broadway, New York, New York. The jack 52, used on the larger leg 12, will be of a type similar to the D-6-6 larger in size. These jacks are commercially available, and it is to be understood, of course, that the other commerically-available jacking systems could be used with the present platform.

Figure 4:
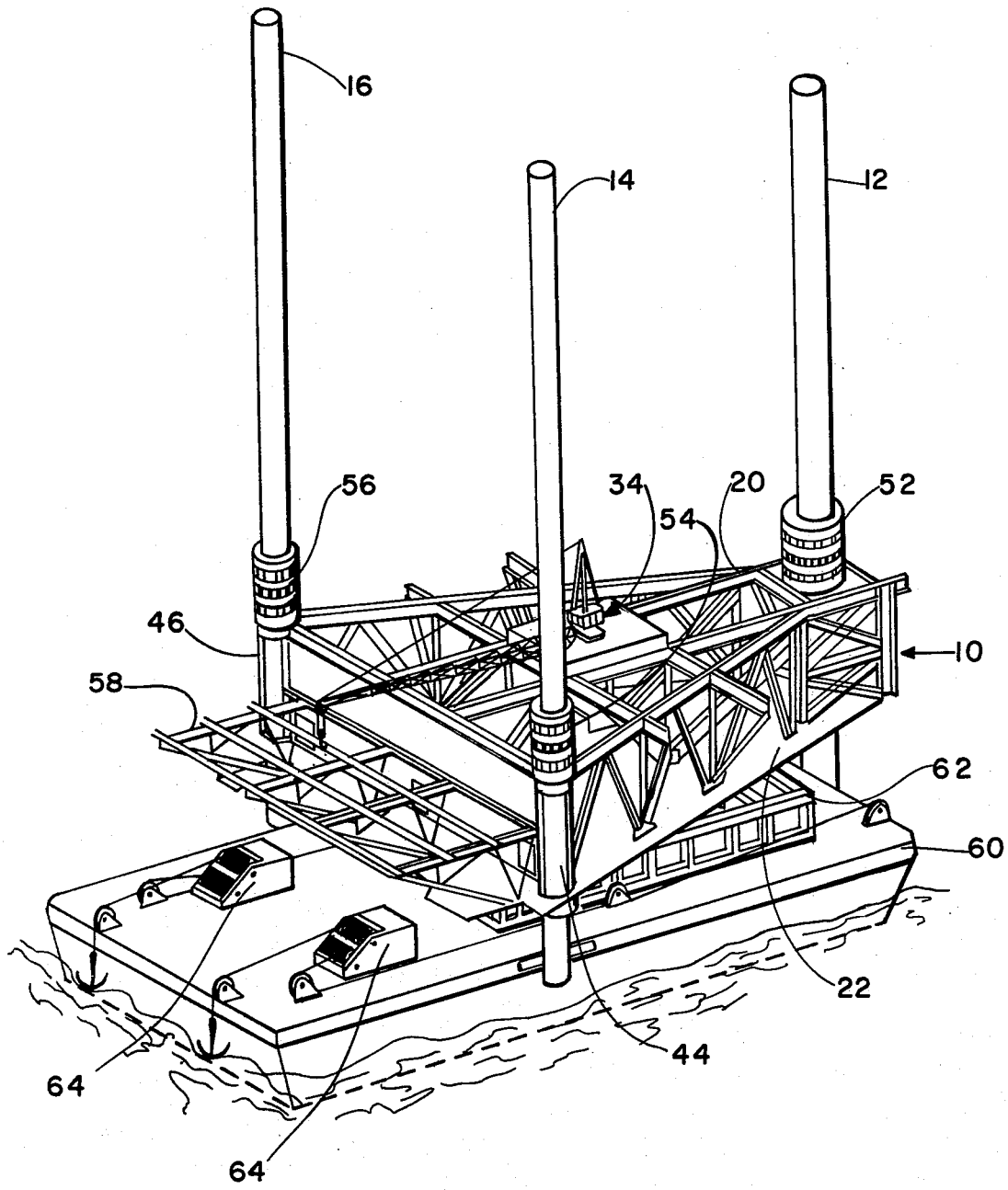
FIG. 4 is a perspective view showing the platform and legs in the towing position on the deck of a simple barge.

As can be seen in FIG. 1, a cantilevered frame assembly 58 (and FIG. 2) is provided on the rear of the platform assembly 10 and positioned between the smaller legs 14 and 16. This cantilevered frame 58 provides support for the modular housing and heliport deck to be attached to the platform assembly 10 after its erection. This assembly will be described hereinafter the detail. Once the platform assembly 10 is assembled, as illustrated in FIGS. 1, 2 and 3, the platform is placed on a barge 60 having a cribbing 62 (see FIG. 4). Barge 60 has a 4 point mooring assembly 64 for use in holding the barge in position during the erection process. The crane 34 is shown supported in the towing position on the deck 20.

Figure 5:
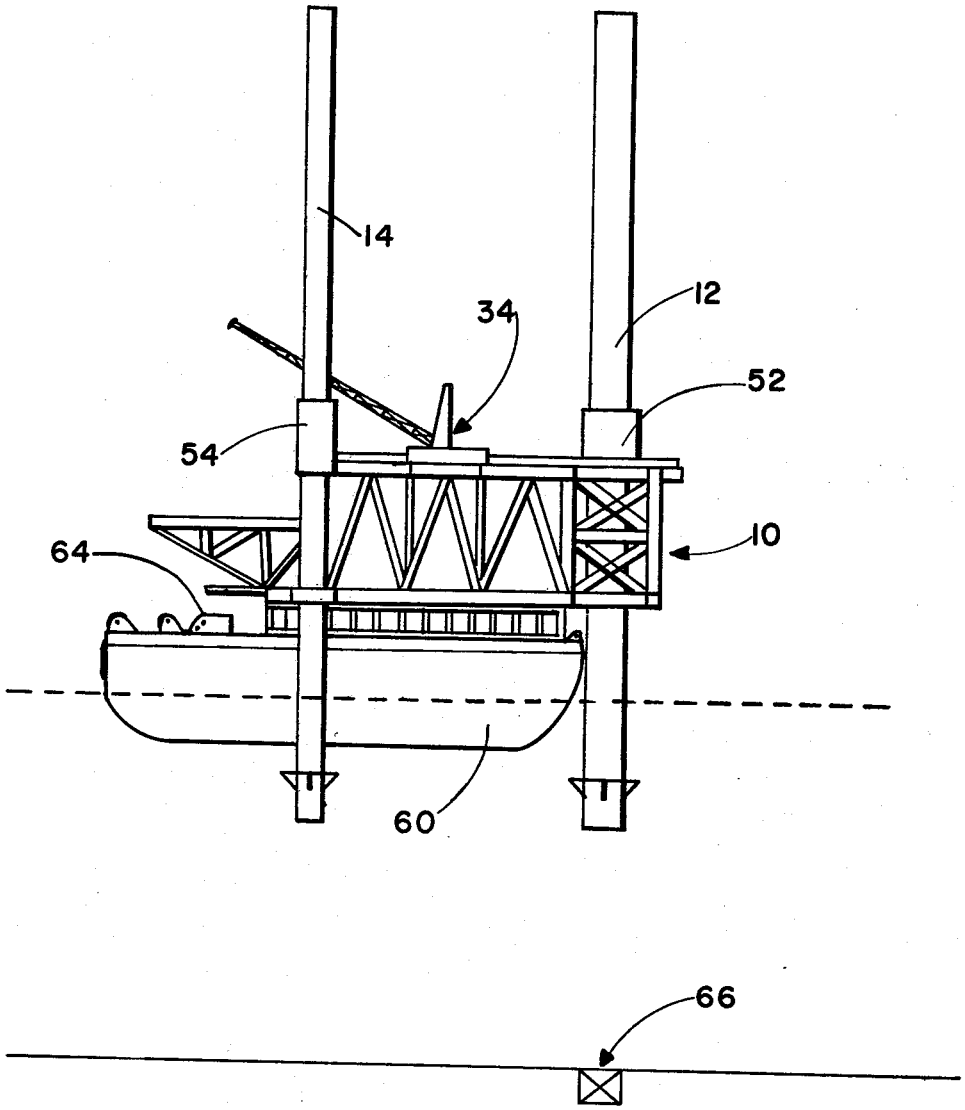
FIG. 5 is a side elevation of the platform in the towing position.
Figure 6:
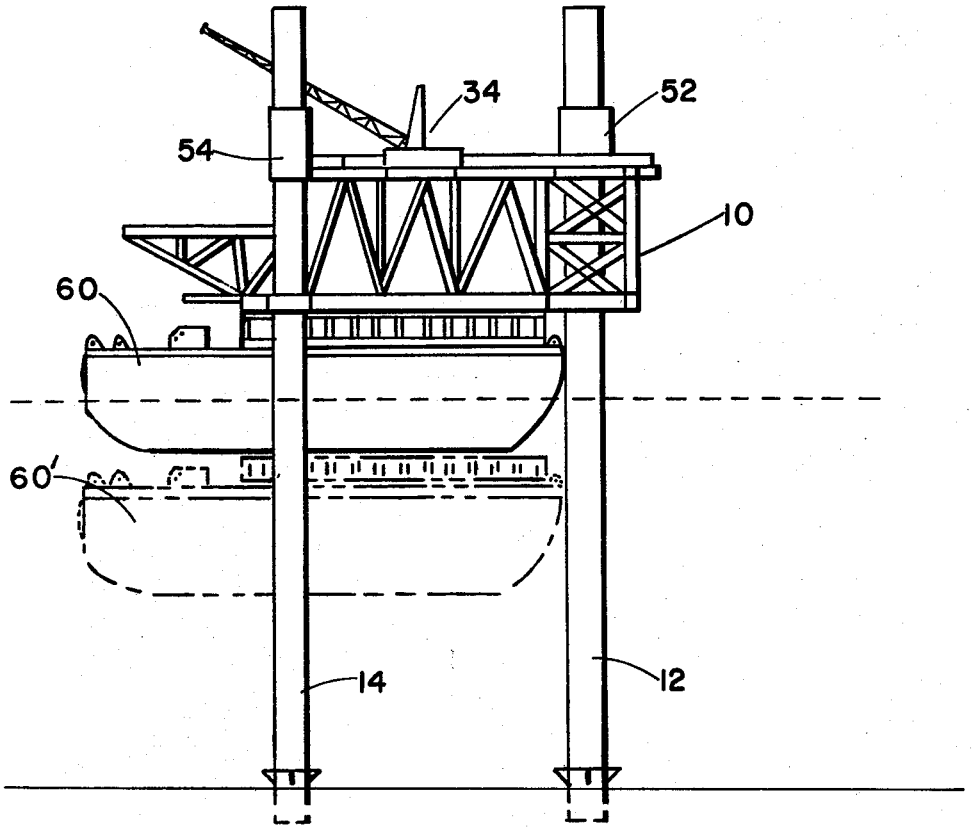
FIG. 6 is a side elevation view illustrating the legs in the down position.

This platform assembly in the towing condition can have some equipment mounted on the lower deck 22 during transportation of the platform to the erection site because the platform is in its normal operating position. The barge 60 is towed to the erectional site and is positioned with leg 12 over the well site 66, as illustrated in FIG. 5. Mooring assembly 64 is then used to moor the barge 60 in position. Thereafter, with the platform assembly 10 in the proper position and the water level at high tide, the legs 12, 14 and 16 are released and allowed to drop and spud into the bottom as illustrated in FIG. 6. The jacks 52, 54, and 56 are engaged to fix the platform 10 on the legs.

Figure 7:
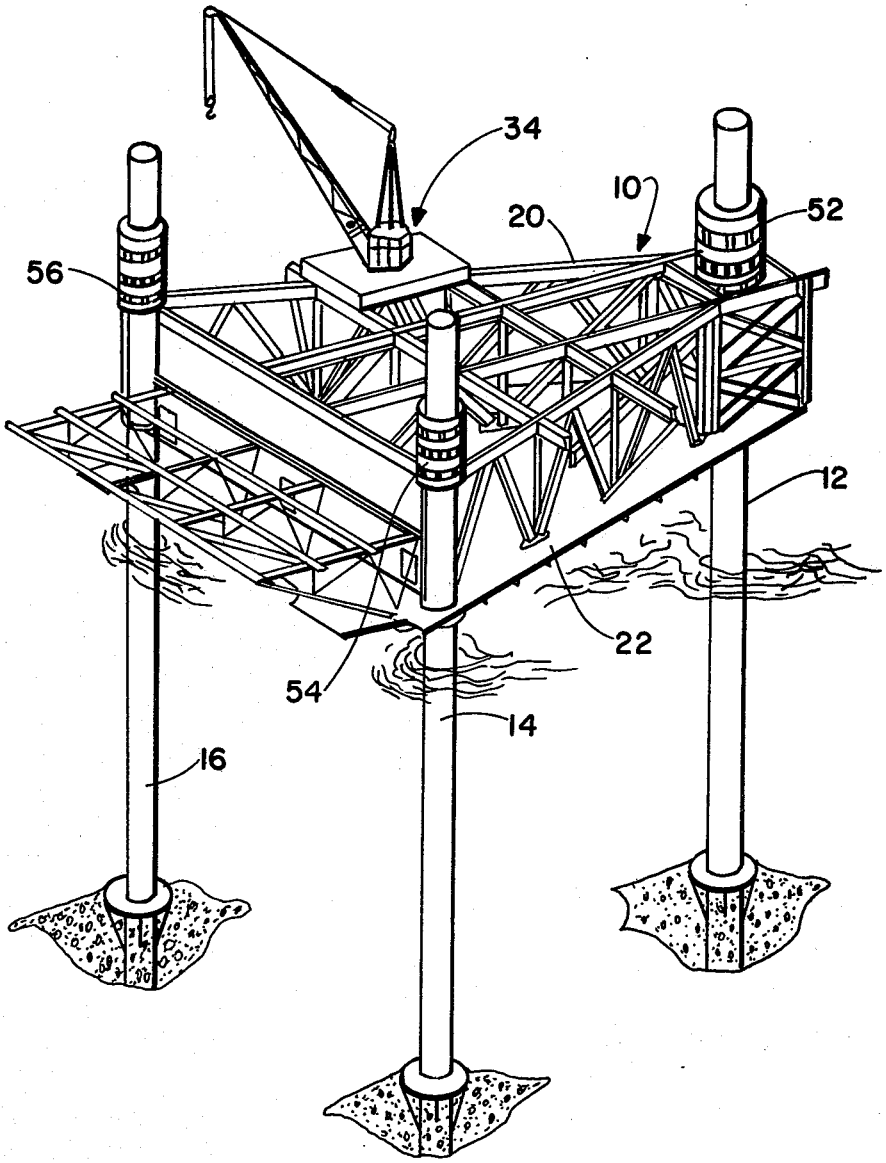
FIG. 7 is a perspective view of the platform in the erected position with the barge removed and the pilings installed through the legs by means of the crane.

The barge 60 is allowed to float away from the platform as the tide subsides to the position illustrated in phantom lines at 60' in FIG. 6. The barge 60 can then be removed from under the platform with the platform in the free-standing position, illustrated in FIG. 7.

Dropping the legs is expected to penetrate into the bottom a sufficient distance to hold the platform in location until permanent foundations can be installed. Once the legs are on the bottom, the jacks 52, 54 and 56 are used to elevate the platform above the wave action to the desired operation height. The additional weight of the platform will produce an additional leg penetration. After the legs are set, the platform will be stable and the equipment necessary for forming the permanent foundations can be loaded onto the platform.

The permanent foundations for each of the two legs 14 and 16 can be accomplished by driving piles through the legs. This can be accomplished by use of the crane 34 without the requirement of the derrick barge to drive the pilings. The pilings can be grouted on the inside of the legs as is conventional in the art. Depending on the soil and bottom conditions, various conventional anchoring systems can be used. The large caisson leg 12 can be provided with conductors to allow anchoring of the leg 12 and drilling therethrough.

Figure 8:
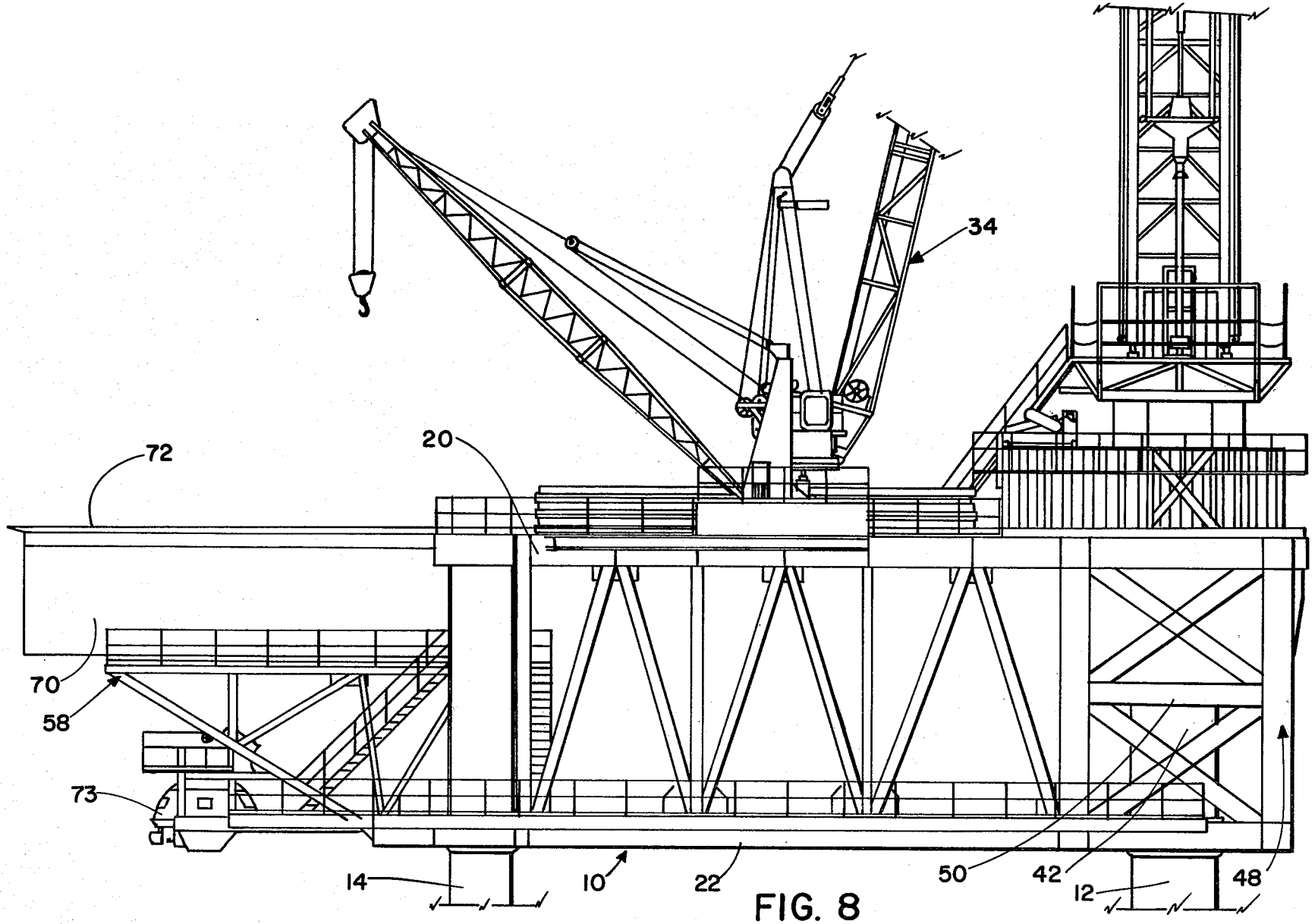
FIG. 8 is an enlarged side elevation of the barge in the erected position with the jacks removed and the drilling equipment mounted on the deck.

Once the foundations are completed, the platform can be leveled and the legs welded to the platform to provide a rigid structure. Jacks 52, 54 and 56 can be removed and the upper-extending portions of the legs cut off at the deck, as illustrated in FIG. 8. Each of the legs 14 and 16 are welded at the upper and lower ends of the leg wells 44 and 46, to rigidly fix them to the platform 10. As can be seen in FIG. 8, a portion of the leg well 42 and leg 12 extending above the intermediate horizontally-extending frame member 50 is removed. Leg 12 and well 42 are welded to the frame 50 in addition to welds at the lower end of the leg well 42.

Figure 10:
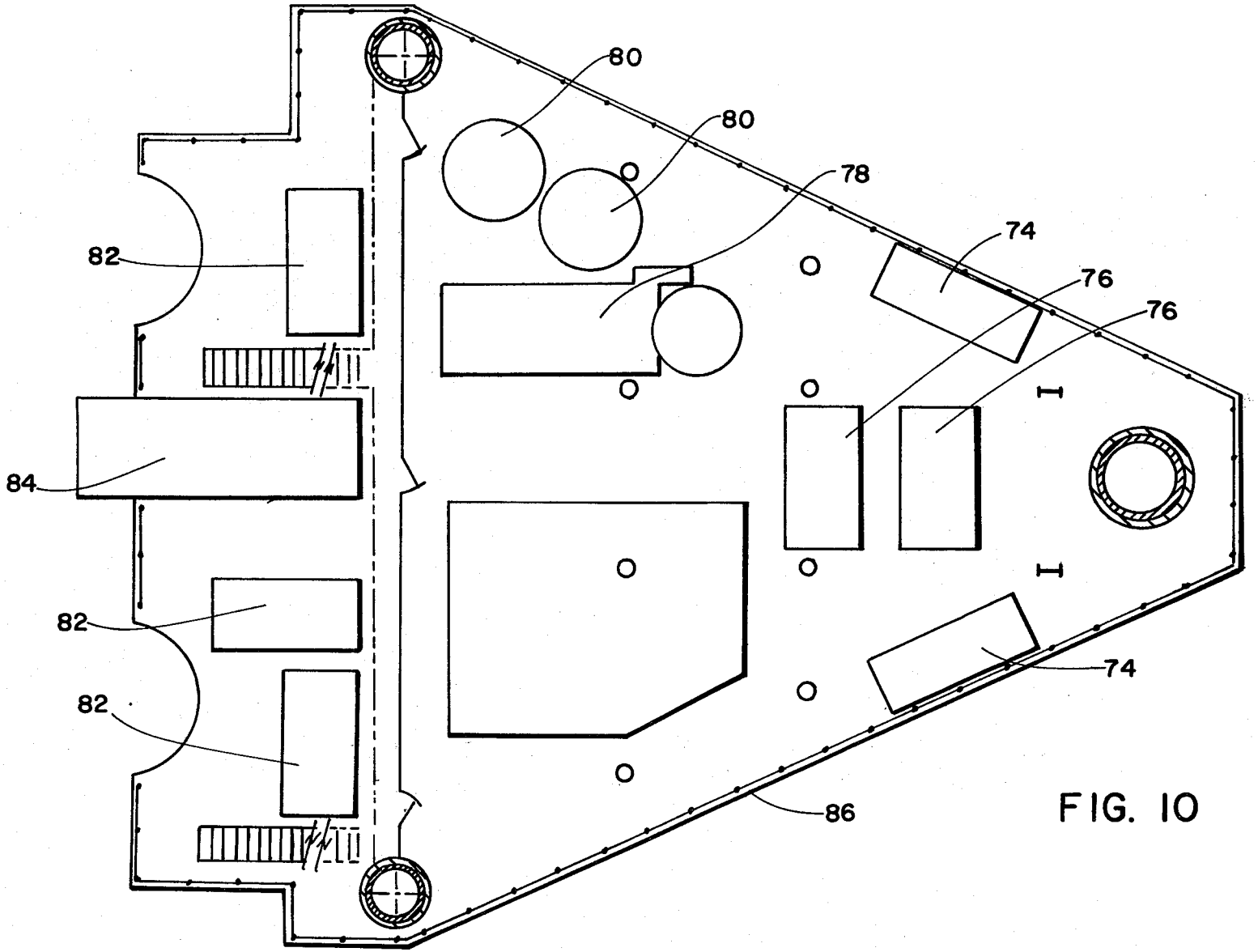
FIG. 10 is a plan view of the lower equipment deck with the equipment installed thereon.

As is illustrated in FIG. 8, once the connection of the legs is completed, the quarters assembly 70 with the heliport 72 thereon is set on and supported from the cantilevered frame 58. Survival equipment 73 can be supported from the portion 38, as shown. Crane 34 is used to install the equipment to be mounted on the lower deck 22. In FIG. 10, equipment such as the hydraulic power unit 74, mud pumps 76, cementing unit 78, P-tanks 80, generators 82 and the SCR and motor control module 84 are shown and handrails 86 are assembled around the lower deck as shown.

Figure 9:
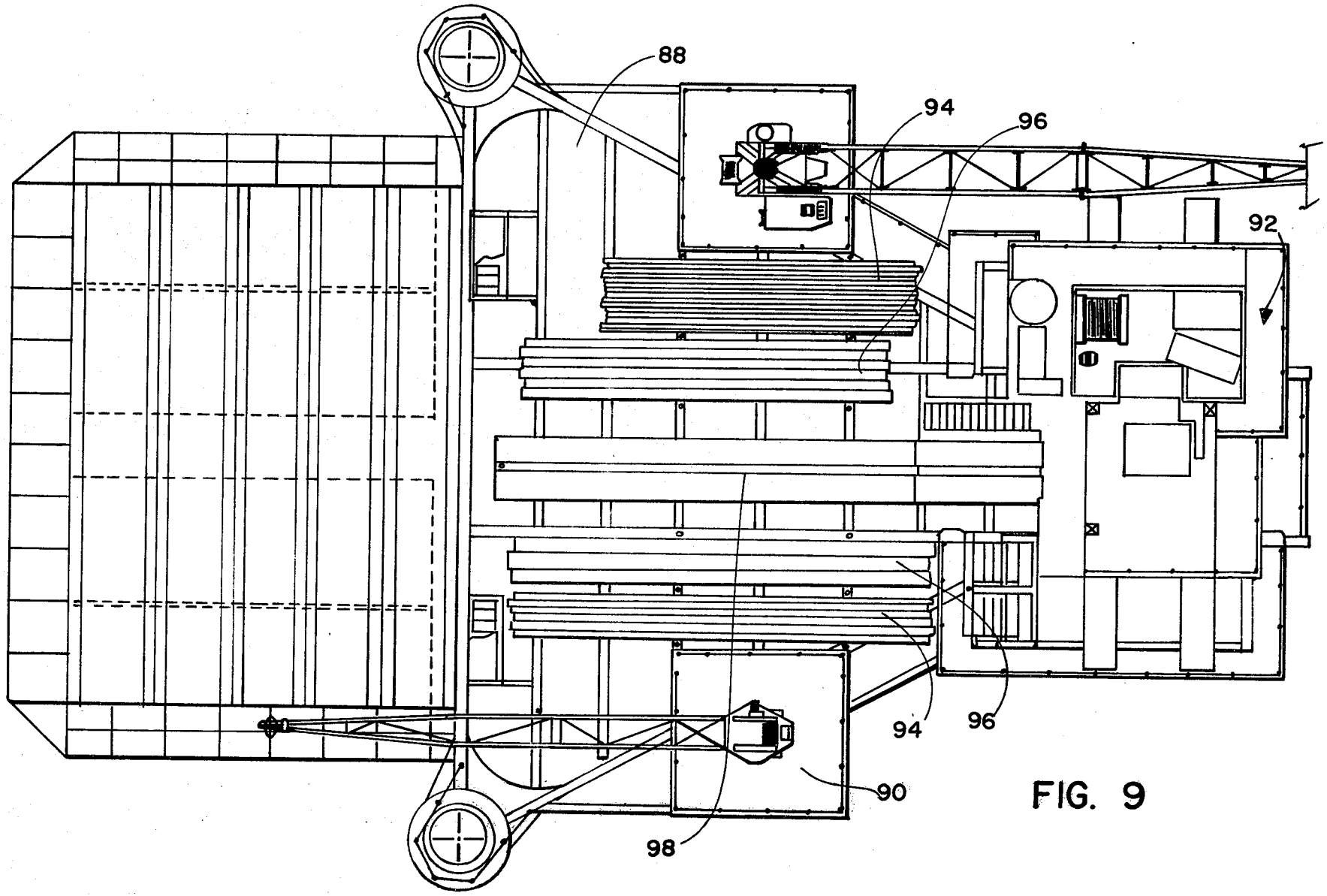
FIG. 9 is a plan view of the upper drilling equipment deck with the equipment installed thereon.

Thereafter, removable grading panels 88 are mounted on the upper deck 20, as illustrated in FIG. 9. The crane 90 can be placed on the deck along with the drilling module 92, positioned over the larger leg 12. The upper deck 20 provides storage space for material such as drill pipe 94, casings, and the like. A pipe walk 98 of conventional construction is supported on the upper deck.

After completion of a drilling program, all drilling-related equipment can be removed from the platform by the deck cranes. The removable upper deck panels facilitate equipment removal from the lower deck. Production equipment can then be installed to utilize the platform in a production mode. One of the cranes can be left on the deck for moving equipment or placing workover equipment on the platform.

It is important to note that the platform embodying the present invention can be erected to form a fixed off-shore platform without the necessity of using a derrick barge, as is typically required in the installation of fixed platforms. The platform is adapted to be moved to the construction site in its normal operating orientation, thus allowing the placement and mounting of some equipment on the deck and eliminates the necessity of having a separate drilling platform mounted on an underwater leg derrick arrangement. A deck mounted crane is provided for driving pilings through the legs freeing the transportation barge. In addition, removable panels on the upper frame allow the insertion and removal of equipment from the lower deck by use of deck mounted cranes.

Although the present specification relates to a particular embodiment of the present invention, it is to be understood, of course, that other embodiments can be utilized to practice the present invention by those of ordinary skill in the art without departing from the spirit and scope of the invention as defined in the appended claims.

What is claimed is:

1. A non-buoyant offshore fixed platform comprising:

a lower deck having a floor for supporting equipment thereon, an upper deck having openings therein to permit the passage of equipment therethrough, a deck crane mounted on the upper deck, upper deck floor sections removably supported on said upper deck to close the openings in said upper deck thereby providing an upper deck surface, said upper deck floor sections being removable to permit access to the lower deck from the upper deck whereby the deck crane can be used to move equipment between the upper and lower decks, truss members interconnected between said lower deck and said upper deck to support said upper deck from said lower deck, said truss members being spaced such that equipment moved through one of said openings may be lowered onto the area underlying said opening and onto the area underlying openings adjacent thereto, support legs, elevating means for moving said upper and lower decks relative to said support legs, and means for fixing said legs relative to said upper and lower decks.

2. The apparatus of claim 1 wherein said truss members form an open truss between said lower and upper decks.

3. The apparatus of claim 1 additionally comprising a cantilevered housing frame extending from said platform assembly and a modular housing assembly removably supported from said housing frame.

4. The apparatus of claim 3 wherein the platform has three legs and said housing frame extends from between two of the legs.

5. An offshore platform for supporting drilling equipment above the ocean floor comprising:

a platform frame having a truss of structural members defining upper and lower horizontally spaced deck levels, a first track including a first pair of structural members spaced apart in parallel relation on the upper deck level of said platform, a second track including a second pair of structural members spaced apart in parallel relation on the upper deck level of said platform, said second track oriented angularly to and intersecting said first track, a movable deck crane adapted to move longitudinally on said first track or transversely along said second track, lower deck structure fixed to said platform frame at said lower deck level for supporting equipment thereon, upper deck floor sections removably supported on said platform frame at said upper deck level for providing an upper deck surface when said sections are in place and for providing access to said lower deck level from the upper deck whereby said crane can operate from said first or second track to move equipment between the upper and lower deck levels and to move equipment laterally from point to point on the lower level, and leg means for supporting said platform frame from the ocean floor.

6. The apparatus of claim 5 wherein said platform assembly is of triangular shape having one of three legs at each of the vertices.

* * * * *